US005558116A

United States Patent [19]

Dubach

[11] Patent Number: 5,558,116

[45] Date of Patent: Sep. 24, 1996

[54] METERING CAP

[75] Inventor: Werner F. Dubach, Maur, Switzerland

[73] Assignee: Createchnic AG, Switzerland

[21] Appl. No.: 394,025

[22] Filed: Feb. 22, 1995

[30] Foreign Application Priority Data

Mar. 7, 1994 [CH] Switzerland ..... 665/94

[51] Int. Cl.[6] ..... G05D 11/03

[52] U.S. Cl. ..... 137/101.11; 137/98

[58] Field of Search ..... 137/99, 101.11, 137/98

[56] References Cited

U.S. PATENT DOCUMENTS

| | | | |
|---|---|---|---|
| 2,543,941 | 3/1951 | Sargent | 137/99 X |
| 2,873,889 | 2/1959 | Mori | 137/99 |
| 3,054,417 | 9/1962 | Corvisier | 137/99 |
| 3,095,892 | 7/1963 | Laing et al. | 137/101.11 |
| 3,266,597 | 8/1966 | Sochting et al. | 137/101.11 X |
| 3,549,048 | 12/1970 | Goodman | 137/99 |
| 3,575,535 | 4/1971 | Bickar | 137/99 |
| 5,009,244 | 4/1991 | Grindley et al. | 137/101.11 |
| 5,012,837 | 5/1991 | Zepp | 137/99 |
| 5,213,129 | 5/1993 | Someah et al. | 137/101.11 |

FOREIGN PATENT DOCUMENTS

| | | |
|---|---|---|
| 0022179 | 1/1981 | European Pat. Off. . |
| 2313971 | 1/1977 | France . |

*Primary Examiner*—Stephen M. Hepperle
*Attorney, Agent, or Firm*—Speckman, Pauley & Fejer

[57] ABSTRACT

A metering cap in which a first component of a flowable material is squeezed out of a cartridge (C) which can be emptied by means of a press (P). The main component flows through a feed line (8) to an outlet line (11) and, in the process, drives two rotors (31) seated in a metering chamber (9) in a housing (1). Gear wheels (34) are seated on the shafts (30) of the rotors (31), which mesh with each other and, in this way, form a gear pump (24). The gear pump (24) conveys an admixing component from an integrated container (18) through a second feed line (23) into the outlet line (11). At least two components can be admixed in a metered manner in an extremely exact ratio to each other by the metering cap of this invention.

11 Claims, 2 Drawing Sheets

METERING CAP

BACKGROUND OF THE INVENTION

1. Field of the Invention

This invention relates to a metering cap for the metered combination of two flowable components, which can be indirectly or directly placed on a container of the main component which can be actively emptied and which has an aspirating or feed line and an outlet line.

2. Description of Prior Art

In commerce as well as in industry, there is an always recurring requirement of metering two flowable components in a defined ratio and combining them. This is most simply realized industrially in that both components are volumetrically conveyed independently of each other and combined, and are only mixed at the place where they are brought together. This system is elaborate, because it requires two conveying devices acting independently of each other, which must be matched to each other by special controls for obtaining the appropriate mixture ratio. Such mixing systems are extremely unsuited for commercial applications or for applications requiring a high degree of mobility. Accordingly, it is necessary to improvise by first bringing the two components to be mixed together in a special container in the desired proportions, then to mix them and to fill them into a special dispenser. This is elaborate and unpleasant in handling, leading to considerable soiling and unavoidable losses of material.

With mixtures of two flowable components which are intended to be metered at approximately the same proportions and brought together, the two components are supplied in cartridges and the contents of both cartridges are simultaneously squeezed out in a single pressing device.

In connection with the present invention it is desired to make use of the known, commercially available cartridges and to use the also commercially known pressing devices. It is accordingly presumed that the quantitatively larger main component is available in a container which can be actively emptied.

A particularly serious problem arises in cases where the media to be mixed are very viscous. Given this premise, this results in the requirement that the metering cap must be laid out in accordance with flow technology in such a way that the smallest possible flow resistance occurs, and it must be possible to manufacture the metering cap with the fewest possible plastic parts.

The general idea to employ two pumps for mixing two media, both respectively causing a volumetric conveyance of the media to be mixed and to connect them mechanically, as a result of which a predetermined mixture ratio results, is taught by French Patent Publication FR-A-2 313 971. In this case, both media are present under pressure. The volumetrically metered components are conducted through appropriate lines into a separate high-pressure mixing chamber, conveyed outside of the pump and are there mixed together by a separately driven mixer.

Such an arrangement cannot be realized as a cap on a cartridge which can be squeezed out and is too expensive.

In contrast thereto, European Patent Publication EP-A-022,179 discloses a metering device with two pumps enclosed in a housing. The main medium drives a turbine-like hydraulic motor which acts on a piston pump which supplies an admixing component to the main component. The system is suited for fluid media, however, the hydraulic motor only permits inexact volumetric metering.

However, the mixing device in accordance with U.S. Pat. No. 3,054,417 operates precisely. Three pumps are used here. The main component is supplied under pressure and drives a volumetrically operating pump which drives two pumps for the admixing component by a gear. Here the first pump is used for building up pressure and it has a bypass in which a pressure valve is disposed. The second pump operates as a pure metering pump. If necessary, the pressure build-up pump can be provided with a separate drive motor. Mixing only takes place in the outlet line. There is no mixing chamber. Instead, in this case the flow of the main component is straight in order to achieve the highest possible conveying output. The device is complex and cannot be made of plastic at a reasonable price.

But U.S. Pat. No. 5,012,837 discloses a metering device of simple construction. The main component is present under pressure at a two-bladed metering pump operated as a hydraulic motor. It drives the shaft of a parallel disposed gear pump for the admixing component. Admixing is very exact and also permits low admixture ratios of 1:100. However, the device does not include a mixing unit. Both components are supplied separately and conveyed on separately. Thus, there is no mixing chamber. Both components are supplied and removed on the same side of the housing, which results in enormous flow resistances with viscous components.

SUMMARY OF THE INVENTION

It is the object of the present invention to create a metering cap in the simplest possible way, by which viscous components can be exactly metered and mixed.

This object is attained by a metering cap in accordance with one embodiment of this invention comprising a feed line, an outlet line, and two meshing metering rotors disposed within a metering cap housing, actuated by a pressurized main component and driving a gear pump for an admixing component conveyed from at least one further container through a separate feed line into the main component. The feed line and the outlet line are aligned one on top of the other in the metering cap housing. A mixing chamber is disposed between the metering rotors and the outlet line. The admixing component is introduced into the main component through the separate feed line extending onto it, wherein the mixing chamber is in open contact with the metering chamber in which the rotors turn, by which the metering rotors aid the blending in the mixing chamber.

The straight-line arrangement of this metering cap avoids flow resistance, and the direct disposition of the mixing chamber in an area where the kneading effect of the metering pump is still present results in sufficient mixing, even of viscous components.

If the admixing component is required in only very small amounts, it is also possible to integrate containers for the admixing components in the metering cap.

If larger amounts of the admixing component are required, it can be placed in connectable containers.

So that the containers for the admixing component are cleanly emptied, a floating piston is advantageously attached to them in accordance with one embodiment of this invention.

However, because this could result in underpressure in the containers for the admixing component, a pressure compensating line is provided in accordance with one embodiment of this invention. For an admixing component which is relatively fluid, the pressure compensating line is in communication with the ambient air. However, for an admixing component which is viscous, the existing pressure of the main component can be applied below the floating piston through the pressure compensating line.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 2:
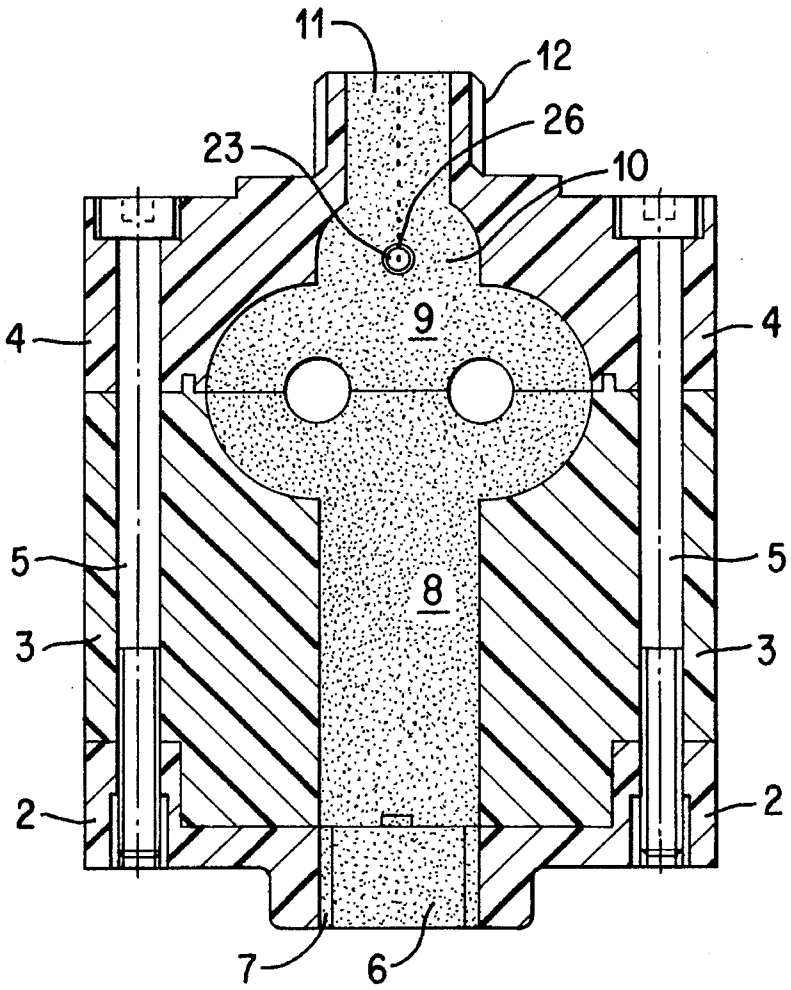
FIG. 2 is a longitudinal cross-sectional view of the metering cap in a plane perpendicular to the shafts of the metering rotors.
Figure 1:
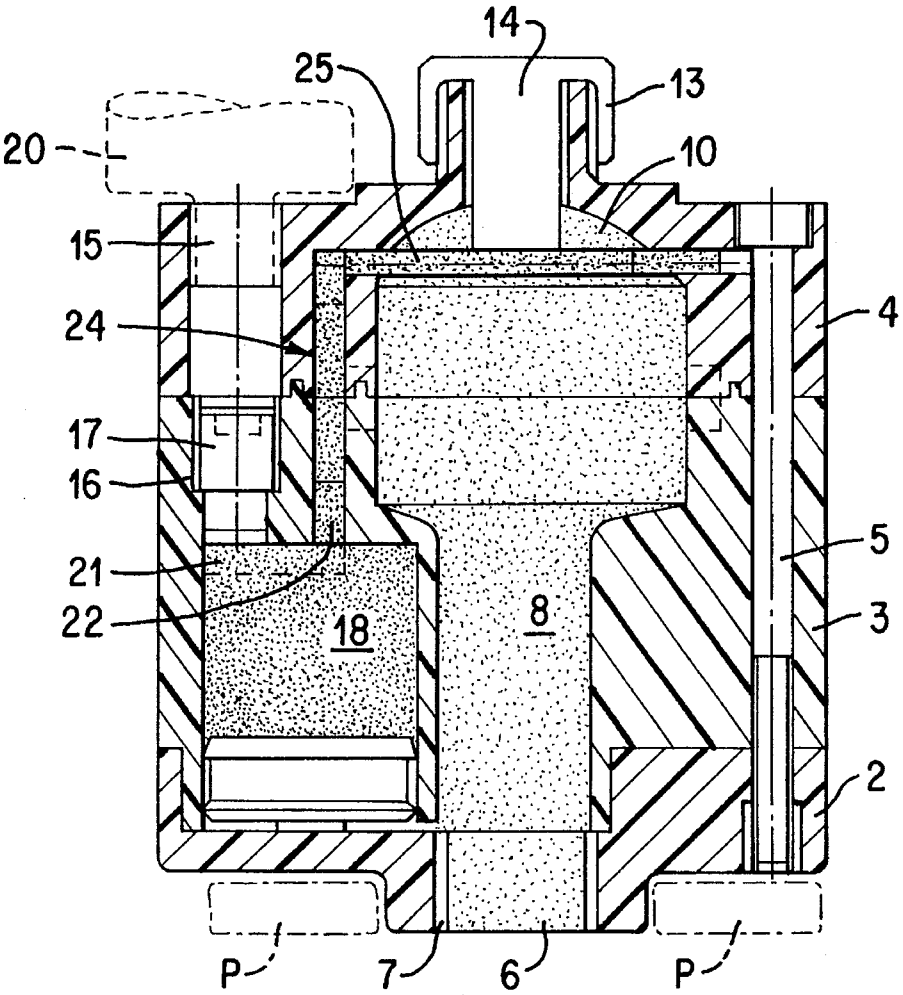
FIG. 1 is a longitudinal cross-sectional view of the metering cap in a plane parallel to the shafts of the metering rotors in accordance with one embodiment of this invention.
Figure 3:
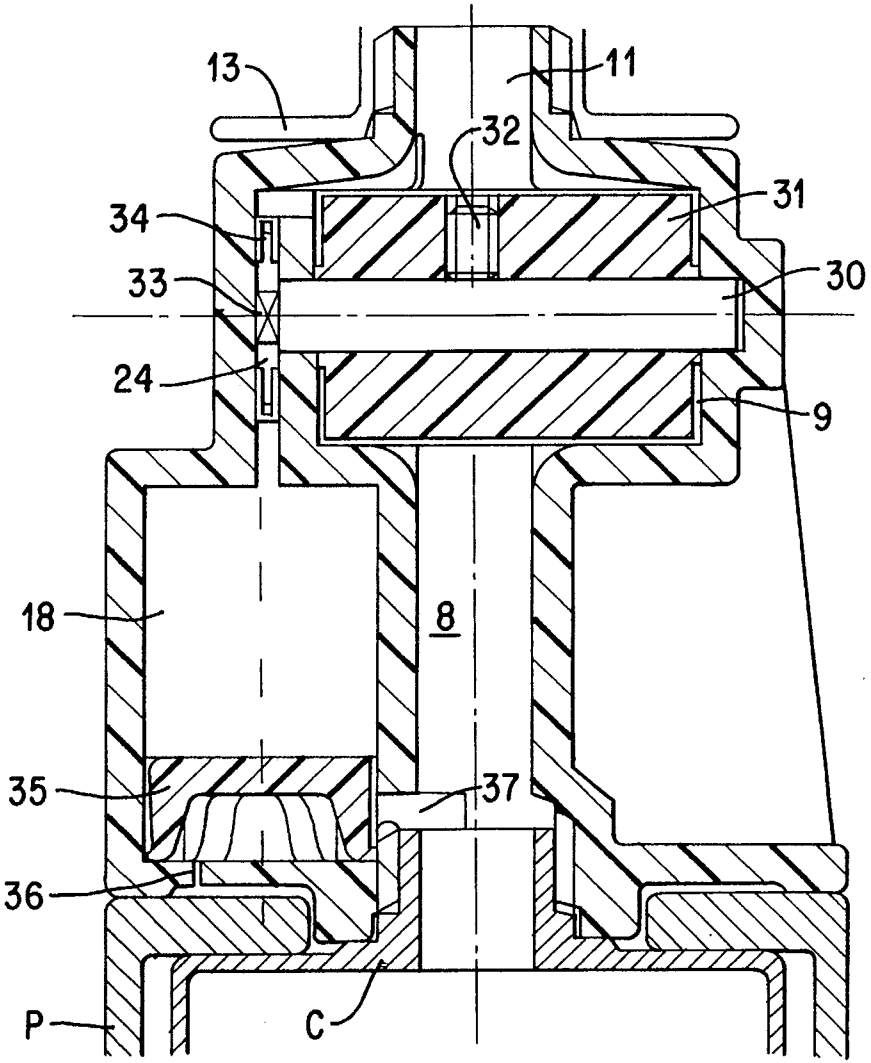
FIG. 3 is a longitudinal cross-sectional view corresponding to FIG. 1 of a metering cap in accordance with another embodiment of this invention.
Figure 4:
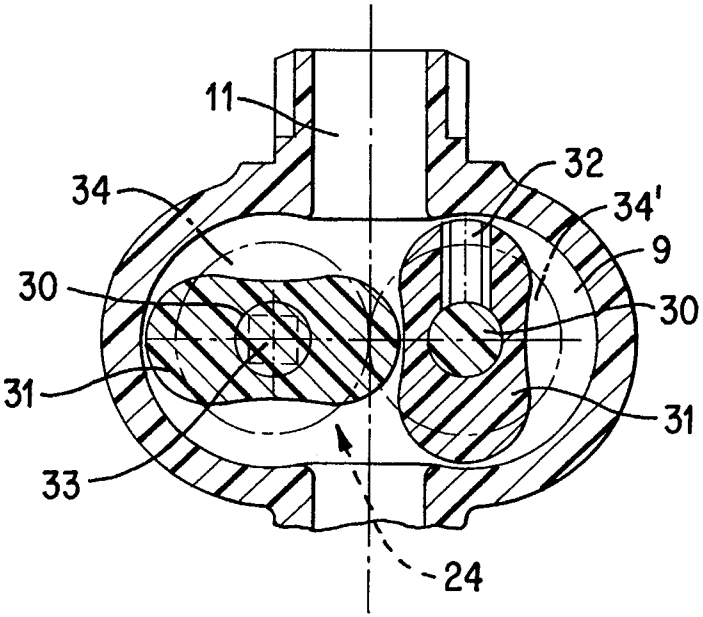
FIG. 4 is a longitudinal partial cross-section in the area of the metering rotors through the device corresponding to FIG. 3.

The flow paths of the two components to be mixed and metered are shown in FIGS. 1 and 2, and the means for conveying and metering the two components are shown in more detail in FIGS. 3 and 4.

The cartridge containing the quantitatively larger main component is shown in FIG. 3. The cartridge is identified by C. It is held in turn in a press, which is only shown in FIGS. 1 and 3. This press P is used for the active emptying of the cartridge C. The embodiments of the metering cap illustrated here are completely made of plastic. Depending on the variant in accordance with extrusion techniques, the dosing cap housing 1 is divided into two parts vertically or horizontally as illustrated in FIG. 3 or, as represented in FIGS. 1 and 2, divided into three horizontally sectioned housing elements. However, this has no functional significance.

The cartridge C contains the main component, which is usually viscous. The metering cap is intended for use preferably for two-component adhesives.

The general structure of the metering cap of this invention is shown in FIGS. 1 and 2. The metering cap comprises three separately manufactured plastic elements. The base plate 2 can be seen on the bottom, by which the connection with the cartridge C, not shown here, is made. The base plate 2 accordingly forms a central opening 6 which can have an interior thread, for example, for a connection to the cartridge C.

The cylindrical center part 3, in which the feed line 8 for the main component arriving from the cartridge is formed, centered and aligned above the opening 6, is located above the base plate 2. The feed line 8 terminates in a metering chamber 9, whose lower half is formed in the cylindrical center part 3 and whose upper half is formed in the head plate 4 disposed above the center part 3. A mixing chamber 10 is formed above the metering chamber 9, in which a second component is introduced into the main component. The mixing chamber 10 makes a direct transition into or already constitutes a part of the outlet line 11, which adjoins the metering chamber in the flow direction.

The mixing chamber 10 is in communication with the metering chamber 9. Nevertheless, a certain amount of a kneading movement is provided by the metering rotors in this area, as a result of which sufficient blending is assured, even with viscous components.

The connector-like outlet line 11 is provided in accordance with one embodiment of this invention with an exterior thread 12, which on one hand can be used for attaching an extension of the outlet line or, on the other hand, can be used for applying a screw cap 13. The screw cap shown in FIG. 1, in addition, has a centered sealing pin 14 which can downwardly extend as far as a feed line in the area of the mixing chamber 10.

The pressure exerted by the press P in the cartridge C pushes the quantitatively larger main component out of the cartridge C through the opening 6 in the base plate 2, through the aspirating or feed line 8 into the metering chamber 9 of the cylindrical center part 3 and then through the metering chamber 10 into the outlet line 11 of the head plate 4. In the process, the flow of the quantitatively larger main component drives the two meshing metering rotors in the metering chamber 9. This is discussed in more detail hereinbelow with reference to FIGS. 3 and 4.

The flow path of the second component, that is, the quantitatively auxiliary or admixing component, can also be seen in the vertical section of FIG. 1. A vertically extending feed opening 15 is formed by the head plate 4. This feed opening 15 terminates in a connector 16 in the cylindrical center part 3. Prior to its first use, the metering cap can therefore be filled with the second, quantitatively lesser admixing component through the feed opening 15 and the connector 16 in case an internal second container 18 for the second component is provided in the metering cap housing. When the internal container 18 is filled, it can be closed, for example, by a screw plug 17 in the connector 16. However, in accordance with one embodiment of this invention, the container for the second component is disposed externally, as shown in dashed lines in FIG. 1, wherein the screw plug 17 is omitted. The internal container 18 may then also be omitted or reduced to a smaller compensating vessel. In accordance with yet another embodiment of this invention, this smaller compensating vessel 21 is also only shown in dashed lines in FIG. 1.

Independently of whether an external container 20, or an internal container 18, integrated into the metering cap housing 1, for the second component is used, the container 18 or 20 communicates indirectly or directly with the end 22 of a feed line 23 at the aspiration side. The feed line 23 extends from the end 22 at the aspiration side through a gear pump 24 to the end 25 at the outlet side in the area of the mixing chamber 10.

The means for conveying and metering the two components are shown in FIGS. 3 and 4. Two shafts 30 extend through the metering chamber 9, wherein one shaft is designed in one piece with a metering rotor 31, while the second metering rotor 32 is clamped angularly fixed to the second rotor shaft by a stud screw 32. The metering rotors 31 as shown are preferably of a two-bladed form. This embodiment is preferred for viscous components in particular. However, if the quantitatively larger main component is more fluid, multi-bladed metering rotors are preferred.

One of the rotor shafts 30 terminates in an output journal 33 having, for example, a square cross section, on which one of the two gear wheels 34 is seated, fixed against relative rotation, while a second gear wheel 34' mated with this gear wheel 34, meshes with it and, thus, forms a gear pump 24.

The gear pump 24 formed of the two gear wheels 34 and 34' thus conveys exactly in agreement to the amount which is conveyed through the metering chamber 9 by the metering rotors 31. Accordingly, the mixture ratio of the two components is therefore only a function of the geometric conditions of the metering means 9 and 31 or of the gear pump 24.

In accordance with one embodiment of this invention wherein the container 18 for the second component is disposed inside the housing 1 of the metering cap, there is the danger that, over time, the gear pump will create an underpressure in the container 18 so that the second component no longer comes into contact with the gear wheels 34 and 34' of the gear pump 24. A floating piston 35 is provided to prevent this. The floating piston 35 automatically advances under the effects of the underpressure in the container 18 and in this way reduces the remaining volume in the container 18 of the second component. So that the piston 35 rises at all, it is first necessary for a pressure gradient to be built up between the underside of the piston and the top of the piston. For this purpose, a pressure compensation line 36 is provided which directly communicates with the ambient air. However, in accordance with one preferred embodiment, the pressure compensation line 37 communicates between the aspirating or feed line 8 and the container 18. Thus, the pressure of the main component prevailing in the aspirating or feed line 8 can spread through the pressure compensation line 37 into the area below the floating piston 35 in the second container 18. As a result, the gear pump 24 is always in contact with the second admixing component.

The basic concept of this invention is that the exerted pressure of the quantitatively main component is utilized for driving the metering rotors, wherein they simultaneously drive a gear pump for conveying the second component.

The end 25 at the output side of the feed line 23 can also be of various designs. In accordance with one preferred embodiment of this invention, it is designed as a small tube extending through the outlet line 11, wherein at least one outlet opening is disposed on the side remote from the flow.

Although the blending of only two components is illustrated and described in the examples, it is possible to seat further gear wheels on the shafts of the metering rotors, which form one or more additional gear pumps. In accordance with a particularly preferred embodiment, the entire metering cap is designed to be symmetrical and, thus, has a gear pump on both sides.

The components to be metered by the device of this invention can be in any arbitrary volume relationship. Therefore, the designations main component and auxiliary or admixing components are understood to be only declaratory.

In the same way in which it is possible to dispose several gear pumps in the metering cap, it is, of course, also possible to arrange two containers symmetrically in the metering cap or to design several to be connectable from the outside.

What is claimed is:

1. In a metering cap for the metered combination of at least two flowable components comprising a first feed line (8) and an outlet line (11), at least two meshing metering rotors (31) disposed in a metering cap housing (1), said meshing metering rotors (31) actuable by a pressurized main component and driving a gear pump (24) for at least one admixing component which is conducted from at least a first distal container (18, 20) through a second feed line (23) into the pressurized main component, the improvement comprising: said first feed line (8) and the outlet line (11) substantially aligned in the metering cap housing (1), a mixing chamber (10) disposed between the meshing metering rotors (31) and the outlet line (11), the at least one admixing component introducible into the main component through said second feed line (23) extending onto said main component, and said mixing chamber (10) in communication with the metering chamber (8) in which the meshing metering rotors (31) turn, whereby the meshing metering rotors (31) aid the blending of said main component and said at least one admixing component in the mixing chamber (10); at least one gear wheel (34) of the .gear pump (24) disposed, fixed against relative rotation, on at least one rotor shaft of the at least two meshing metering rotors (31), said at least one gear wheel (34) meshing with a second gear wheel (34) of the gear pump (24); and said second feed line (23) for the at least one admixing component in the form of a tube extending through said mixing chamber (10) and having at least one outlet opening (26) on a side remote from a flow.

2. In a metering cap in accordance with claim 1, wherein said at least first distal container (18) for the at least one admixing component is integrated into the metering cap housing (1).

3. In a metering cap in accordance with claim 1, wherein a second distal container (20) for the at least one admixing component is connected to the metering cap housing (1).

4. In a metering cap in accordance with claim 2, wherein a floating piston (35) is seated in the integrated said at least first distal container (18).

5. In a metering cap in accordance with claim 4 further comprising a pressure compensation line (36, 37) terminating in a lower area of the integrated said at least first distal container (18).

6. In a metering cap in accordance with claim 5, wherein the pressure compensation line (36) communicates with ambient air.

7. In a metering cap in accordance with claim 5, wherein the pressure compensation line (37) is in communication with the first feed line (8) for the pressurized main component.

8. In a metering cap in accordance with claim 1, wherein the second gear wheel (34') of the gear pump (24) is seated freely rotating on the rotor shaft of a second metering rotor of said at least two meshing metering rotors (31).

9. In a metering cap in accordance with claim 1, wherein the at least two meshing metering rotors (31) each comprise two blades.

10. In a metering cap in accordance with claim 2, wherein the at least first distal container integrated in the metering cap forms at least one integrated feed opening (15) which can be closed by a screw plug 17.

11. In a metering cap in accordance with claim 1, wherein the outlet line (11) can be closed by a screw top (13) with a sealing pin (14) of sufficient length such that in a closing state, it sealingly rests on the at least one outlet opening in the second feed line (23).

* * * * *